United States Patent [19]

Cormier

[11] Patent Number: 4,815,020

[45] Date of Patent: Mar. 21, 1989

[54] METHOD AND APPARATUS FOR COMPUTING GOLF GAME PARAMETERS

[76] Inventor: Wayne L. Cormier, 3817 Shasta Dr., Santa Clara, Calif. 95051

[21] Appl. No.: 23,450

[22] Filed: Mar. 9, 1987

[51] Int. Cl.[4] ..... G06F 15/28

[52] U.S. Cl. ..... 364/709.11; 364/410; 364/561; 273/87 R; 273/77 R

[58] Field of Search ..... 364/709, 410, 411, 561; 273/87 R, DIG. 28, 77 R

[56] References Cited

U.S. PATENT DOCUMENTS

| | | | |
|---|---|---|---|
| 4,063,259 | 12/1977 | Lynch et al. | 273/77 R |
| 4,136,394 | 1/1979 | Jones et al. | 364/410 |
| 4,698,781 | 10/1987 | Cockerell, Jr. | 364/561 |
| 4,703,444 | 10/1987 | Storms, Jr. et al. | 364/561 |

*Primary Examiner*—Gary V. Harkcom
*Assistant Examiner*—Long Thanh Nguyen
*Attorney, Agent, or Firm*—A. C. Smith

[57] ABSTRACT

An apparatus and method for determining remaining distance to the green and for selecting an appropriate club to use in advancing the golf ball over the remaining distance. A device for storing the distances achieved in the past with a selected club is operated to yield a statistical value useful in selecting the club to use on the next stroke. In addition, the method and apparatus measures directly the distance achieved with the club used to advance the golf ball toward the green, and performance information is continually updated to provide currently-accurate performance information upon which to base the selection about which club to use on the next stroke.

6 Claims, 8 Drawing Sheets

| | SAND WEDGE | PITCH-ING WEDGE | #9 IRON | #8 IRON | #7 IRON | #6 IRON | #5 IRON | #4 IRON | #3 IRON | #2 IRON | #5 WOOD | #4 WOOD | #3 WOOD | #2 WOOD | #1 WOOD |
|---|---|---|---|---|---|---|---|---|---|---|---|---|---|---|---|
| 1 | | | | | | | | | | | | | | | |
| 2 | | | | | | | | | | | | | | | |
| 3 | | | | | | | | | | | | | | | |
| 4 | | | | | | | | | | | | | | | |
| 5 | | | | | | | | | | | | | | | |
| 6 | | | | | | | | | | | | | | | |
| 7 | | | | | | | | | | | | | | | |
| 8 | | | | | | | | | | | | | | | |
| 9 | | | | | | | | | | | | | | | |
| 10 | | | | | | | | | | | | | | | |

63

Figure 6

METHOD AND APPARATUS FOR COMPUTING GOLF GAME PARAMETERS

BACKGROUND OF THE INVENTION

This invention relates to the game of golf, and more particularly to the method and apparatus useful in determining club selection.

The game of golf is played by using one of a number of clubs to drive a ball toward the next hole, or pin. In addition to the skill required to drive the ball, it is also necessary to select a club appropriate to the distance over which the ball is to be driven. In the past, it has been found that this selection is made difficult by uncertainty as to the distance remaining to the pin and uncertainty as to how far an individual normally hits the ball with a given club.

Many golfers have attempted to deal with this problem by relying upon guesswork, making a visual estimation of the distance to the pin and relying upon memory to determine the appropriate choice of clubs. Other golfers have attempted to obtain a more precise selection by using paper and pencil, a calculator, and a simple scheme of pacing off the distance. These expedients have suffered from the disadvantages of being inconvenient, unreliable, and time consuming.

It is therefore an object of the present invention to provide the method and means of providing information about typical, recent club performance, and about the distance remaining to the pin in a convenient, reliable, and timely fashion. It is another object of this invention to provide a portable and precise method and means for calculating the distance remaining to the pin. It is still another object of this invention to provide an apparatus which may be mounted upon or integrated with a hand-drawn, wheeled golf-bag caddy.

SUMMARY OF THE INVENTION

In accordance with the present invention, an electronic device is provided which has a memory, manual and transducer input devices, a microprocessor and a display. The memory stores data representing prior performance with each club, and data needed to calculate the remaining distance to the pin.

Information representing recent, prior performance with each of the golf clubs is stored in a set of memory registers. This information is processed using one of a number of well-known statistical devices, including simple averaging, weighted averaging, or determination of median performance in order to provide a predictor of future performance with each club. As the game progresses, the information stored in the registers is automatically updated to reflect the most recent set of data derived from a player's performance.

The apparatus includes a keyboard for manual entry of selected information and for activatig given functions, and also includes a distance-measuring means, such as a counter and a sensor attached to a wheel. By enterig the official yardage of a fairway or section thereof into the keyboard and then pacing the distance that the ball was actually driven while manually drawing the wheel along, an accurate reading of the distance attained and of distance remaining to the next pin are provided. At the same time, the distance attained and the club used may be entered into the memory registers, thus updating the stored information in those registers.

An angle-measuring device is also provided for use in those instances in which the ball does not travel straight down the fairway. In these cases, the angle between the path of the ball and the direction to the pin is detected, the distance of the ball is paced off and counted with the sensing wheel, and trigonometric functions are applied to find the distance remaining to the pin.

BRIEF DESCRIPTION OF THE DRAWINGS

FIG. 6 is a table for pictorially illustrating the stored distances attained with selector clubs, and FIG. 7 (comprising FIGS. 7A and 7B) represent a flow chart illustrating operation of the present invention.

DETAILED DESCRIPTION OF THE PREFERRED EMBODIMENT

Figure 1:
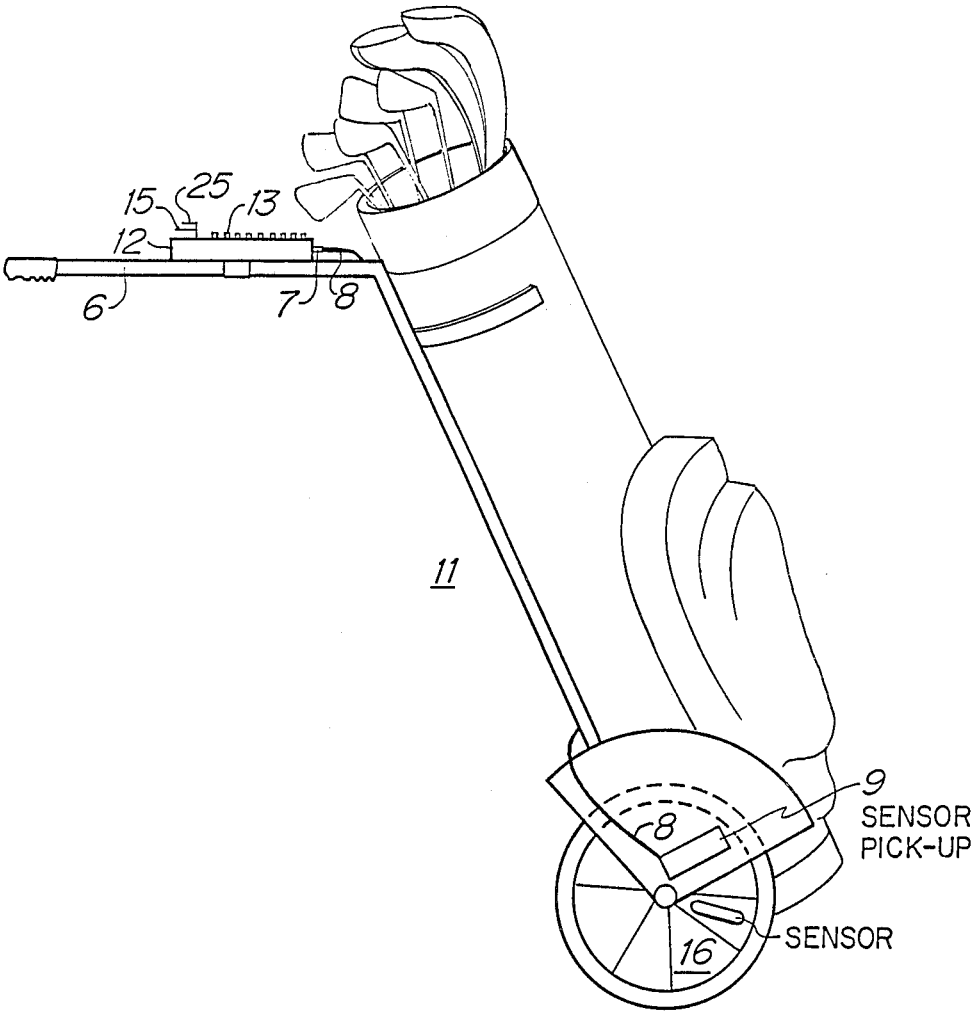
FIG. 1 is a pictorial representation of the present invention installed on a golf caddy having a rotating sensor wheel.

Referring now to FIG. 1, there is shown an embodiment of the present invention wherein a device constructed according to the present invention is removably mounted on a hand-held cart 11. The processing unit 12 is attached to the cart and is connected to a sensing wheel 16 of the cart 11.

The processing unit 12 includes electronic circuitry for performing the functions described below, and includes a keyboard 13, a display 14, and an angle-detecting device 15, 25 for determining angles. As described more fully below, special function keys are included in keyboard 13.

The sensing wheel 16 is adapted to supply pulses via cable 8 to the processing unit 12 as the wheel turns, thereby supplying information representing the distance traveled. A typical and convenient means of providing such pulses is by the use of an opto-electronic emitter and detector pair which respond to reflected or interrupted light as the spokes of wheel 16 pass the emitter and detector pair 9. Alternatively, a magnet may be provided at one or more locations on the wheel which may be conveniently detected by a Hall-effect sensing device.

The processing unit 12 may also include a connector or other interface 17 for use in coupling a printer or other apparatus to the processing unit for permanent read-out of game parameters.

Figure 2:
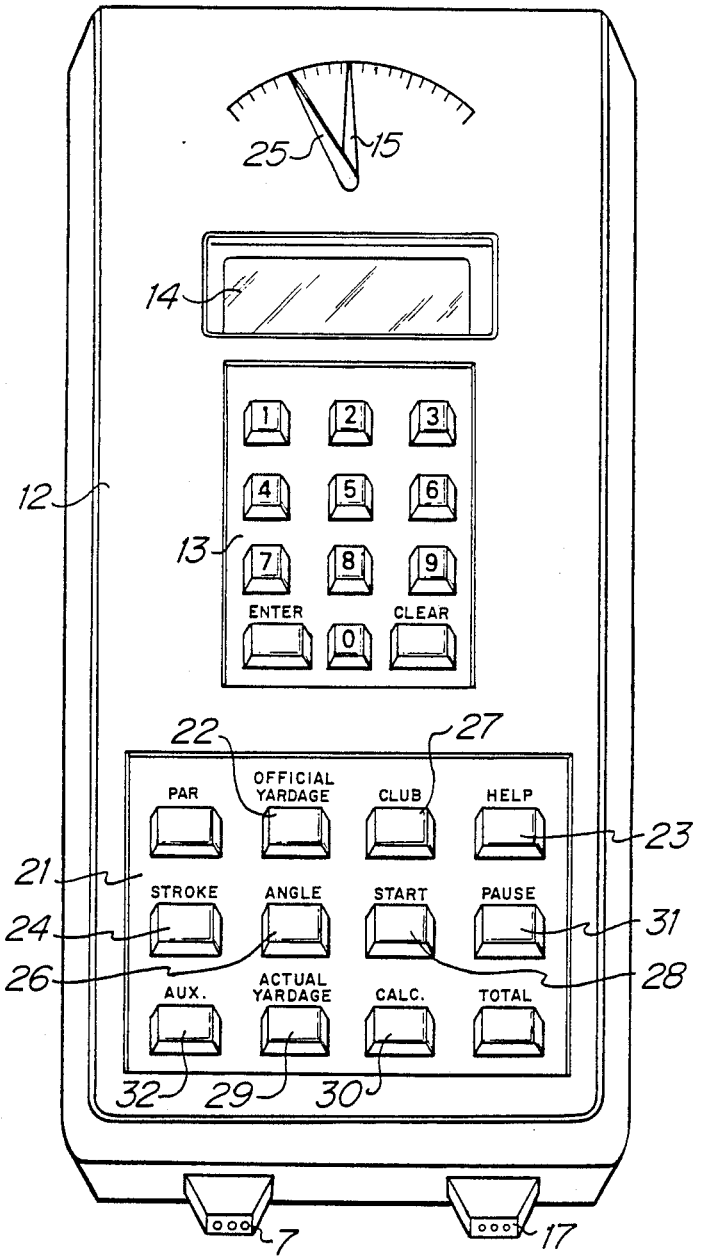
FIG. 2 is a pictorial representation of one embodiment of the present invention for installation on a golf caddy.

Referring now to the illustrated embodiment of the processing unit in FIG. 2, the keyboard 13 may include a standard numeric keyboard additionally provided with "CLEAR" and "ENTER" keys. A plurality of special function keys is also provided.

In operation, the cart 11 with the processor 12 mounted upon it is placed in line with the official yard marker and the yardage to the next pin or green, to the beginning of the next fairway (measured from the official yard marker down the center of the fairway), is entered through the keyboard 13 and the OFFICIAL YARDAGE button 22.

The processing unit may be activated by pressing the HELP key 23 alone to display a club appropriate to the distance remaining. Such display may represent the closest comparison of the distance remaining (or the official yardage) with a statistical sampling of past achievements using various clubs.

If the user desires assistance in choosing a club, then the number of the proposed club may be entered through the keyboard 13 followed by the special function HELP key 23. This will cause the processing unit 12 to display a value representing a predicted performance with the proposed club. This predicted performance may be reached by any of a number of ways including, but not limited to, providing an average of the last ten distances achieved with that club. Alternatively, a median value or weighted mean value may be provided in a manner well known to the field of statistics.

Once a choice of club has been made, the player enters the club used to hit the ball, and calculates the distance that the ball was hit, and the distance remaining in the following manner:

First, the player presses the special function "STROKE" key 24 and enters the number of the club actually used via keyboard 13 and presses the CLUB key 27. After pressing the START key 28 to activate the reception of pulses from the sensing wheel 16, the player then rolls the cart 11 substantially in direct line to the ball. The distance between the location where the stroke was taken and where the ball came to rest is measured by counting the pulses received from the sensing wheel 16. When the user has arrived at the location of the ball the ACTUAL YARDS key 29 is pressed to activate the processing unit 12 to calculate the distance over which the ball has traveled and the distance remaining from the ball to the pin. Additionally, the information regarding the performance with the designated club is added to the appropriate memory register as graphically illustrated in the table of FIG. 6, thus keeping performance information up-to-date. Specifically, the distances attained in each of the last ten strokes with each designated club may be stored and updated by deleting the oldest stored distance and inserting the most recent distance attained with each club.

In the event that the ball did not travel straight down the center of the fairway, the player measures the angle of deviation off center by aiming pointer 15 along the center of the fairway, and by then aiming the pointer 25 toward the point where the ball came to rest. A conventional angle transducer (not shown) attached to the pointers 15 and 25 provides an input directly to the processing unit 12. Once the pointers are aimed along the center of the fairway and at the location of the ball, the ANGLE key 26 is pressed.

It will be understood by those skilled in the art of computers and calculators that the calculations described herein may be performed by a microprocessor in conventional manner in accordance with standard program instructions that may be conveniently stored in a read-only memory. Preferably, the stored information representing performance history with each club is stored in non-volatile memory registers which may be altered during operation of the processing unit 12 so that the information will not be erased when the processing unit 12 is shut off.

Thus, in complex situations, the player calculates the yardage to the pin or to the end of the first fairway segment of a "dog-leg" by pressing the special function CALCULATE key 30. This activates the processing unit 12 to calculate and display the distance remaining to the pin. Even where the pin or the end of the next fairway segment is visible, and is the overall objective, the yardage to the initial objective must be calculated. This information is necessary for calculating the distance from the ball to the initial objective.

In order to calculate the distance between the location of the ball and the new objective, the player enters the official yardage for the next fairway segment via the special function OFFICIAL YARDAGE key 22 and the keyboard 13. Next, with the processing unit 12 positioned adjacent to the ball, the angle between the direction to the first objective and the direction to the second objective is entered via the pointers and the ANGLE key 26. The yardage to the next goal is calculated and displayed in conventional manner when the CALCULATE key 30 is pressed.

In some instances, it is not possible or appropriate to roll a golf cart up to the ball, for example, where the ball has landed in a water trap or in the woods. In these instances, a PAUSE key 31 may be pressed, disabling the entry of distance information from the sensing wheel 16 to the processing unit 12. The processing unit 12 may be detached from the cart 11 and cable 8 and carried by hand to the location of the ball, with the player counting one yard for every step. When the player reaches the ball, the "step-yardage" is entered. This is done by pressing the special function PAUSE key 31 a second time, returning the processing unit 12 to an active state and entering the additional step yardage via the special function AUXILIARY key 32. At this point, the player may take the next stroke with a club selected on the basis of the distance calculation provided and upon consultation with the performance information accessed from the memory registers.

Once the ball is hit, the club used is entered, the pointers 25 and necessary keys are operated to enter the direction, and the distance from the initial location of the ball where the stroke was taken to the new location of the ball are all entered into the processig unit 12 in the manner previously described at each location of the ball over the course of play.

Figure 3:
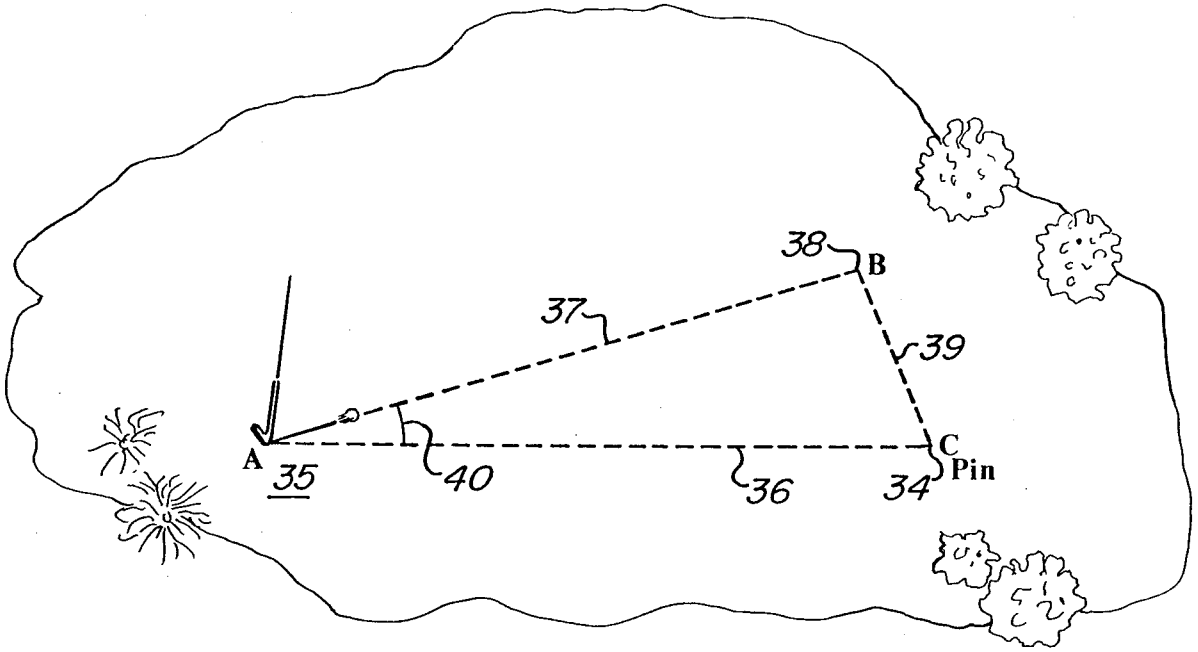
FIG. 3 and 4 are pictorial diagrams illustrating some trigonometric functions involved in computing remaining distance to the pin.

Referring now to the pictorial diagram of FIG. 3, it may be seen that the apparatus and method of the present invention may calculate remaining distance by the conventional application of trigonometric principles. Three trigonometric identities having general application to the solution of non-right triangles are applied when calculating the yardage to the initial, or to the next objectives. These are:

(i) The Law of Sines, which states: The sines of the angles of any triangle are proportional to the lengths of the opposite sides. The processing unit 12 uses the Law of Sines to calculate yardage in all cases where the objective changes from one stroke to the next. The Law of Sines is used to solve triangles where two sides and an angle opposite one of the sides are known.

(ii) Angle Summary Identity for Triangles, which states: The sum of the angles of a triangle equal 180 degrees. The processing unit 12 uses the Angle Summation Identity as an intermediate calculation when using the Law of Sines to derive the distance for a case where the objective has changed from one stroke to the next.

(iii) Law of Cosines states: The square of the side opposite the known angle is equal to the sum of the squares of the other two sides minus twice their product times the cosine of the included angle. The processing unit 12 uses the Law of Cosines to derive the distance for all cases where the objective remains the same from one stroke to the next, including all first strokes. The Law of Cosines is used to solve for remaining distance where two sides and the included angle are known.

Referring again to FIG. 3, there is shown a pictorial diagram of a golf course in a simple case with the pin 34 visible from the tee-off location 35. Line AC 36 connects the pin 34 and the tee 35. Line 36 represents the official yardage to that pin 34. An actual line of travel of the ball is represented by the line segment AB 37. The desired information of yardage to the pin 34 from the location 38 where the ball landed is represented by the line segment BC 39. Line segment AC 36 is known because it is the official yardage to the pin. Line segment AC 37 is measured by the sensor wheel 16. Angle BAC 40 is measured by the pointers 15 and 25 of the angle-measuring means. Thus, by the Law of Cosines above, the distance remaining along line segment BC 39 is simply computed.

Figure 4:
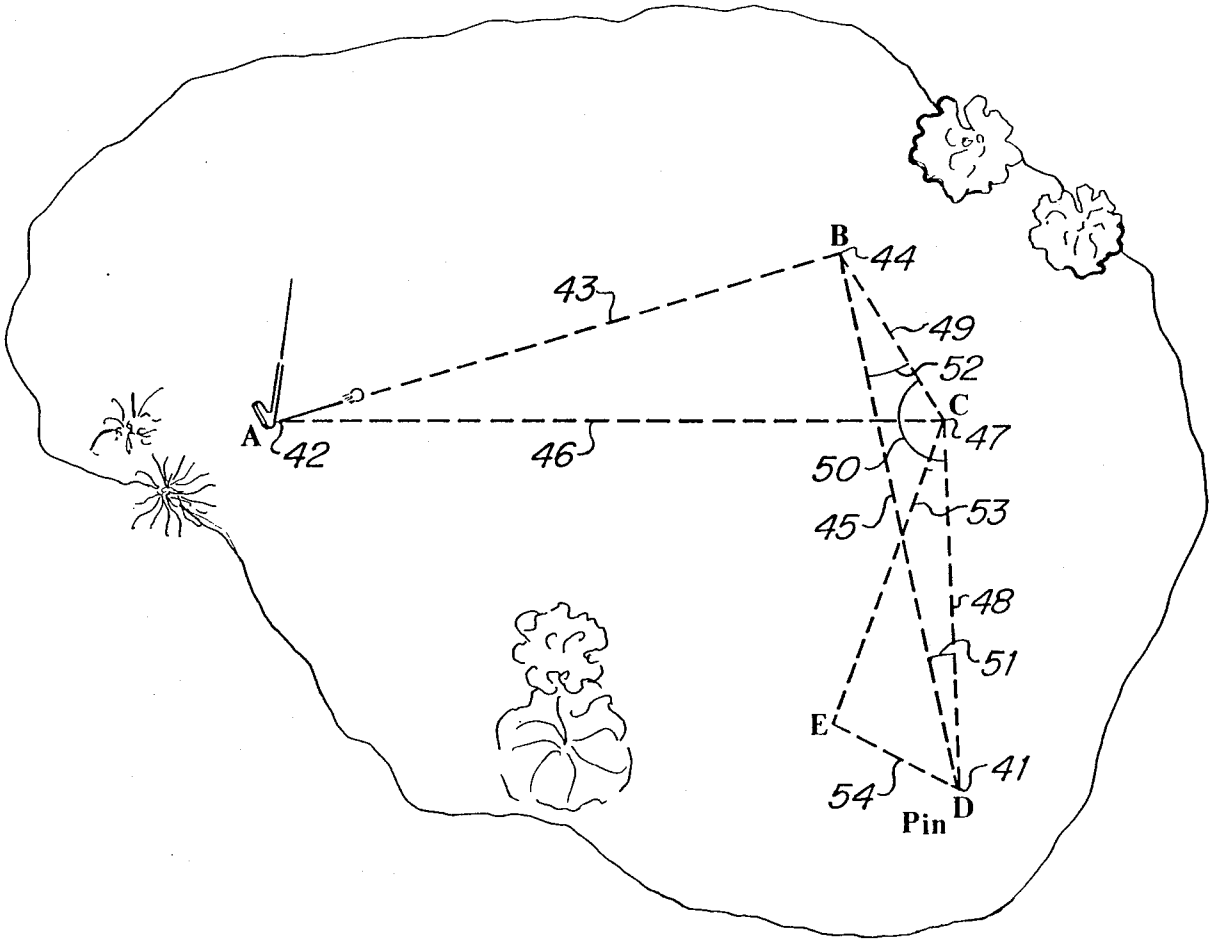
Figure 7:
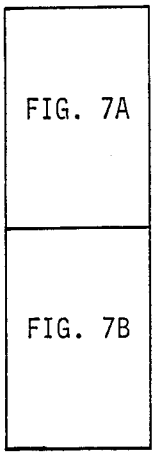

Referring now to FIG. 4, there is shown a pictorial diagram of a golf course with the pin 41 not visible and on a "dog-leg" from the tee-off point 42. Line segment AB 43 represents the official yardage from the tee-off point 42 to the end 44 of the first fairway segment, and line segment BD 45 represents the official yardage from the end 44 of the first fairway segment to the pin 41.

Line segment AC 46 represents the path and distance the ball actually traveled. The desired information about distance remaining to the pin 41 from the location 47 where the ball landed is represented by the line segment CD 48. In order to calculate the value of CD 48 it is first necessary to calculate the distance to the end 44 of the first fairway segment BC 49 from the location 47 where the ball landed. This is done using the Law of Cosines in the manner described above.

Once the distance over line segment BC 49 is determined, the official yardage BD 45 of the second segment is entered. The angle BCD 50 between the end 44 of the first segment and the pin 41 is then entered, using the pointers 15 and 25. The calculation of the distance CD 48 to the pin 41 is then a three-step process. First, the Law of Sines is used with the values of BC 49, BD 45 and angle BCD 50 to calculate the angle CDB 51. Secondly, the Angle Summation Identity for Triangles is used with the angles BCD 50 and CDB 51 to determine the remaining angle CBD 52. Finally, the Law of Sines is used with the values of BD 45, angle BCD 50, and angle CBD 52 to calculate the distance CD 48 to the pin 41.

The line of travel on the second stroke is represented by the line segment CE 53. The distance to the pin is represented by the line segment ED 54. The calculaton of the distance ED 54 is thus in conventional manner using Law of Cosines.

It will be appreciated that the steps described above may be repeated as necessary until the pin is reached. The steps of the simple example previously described with reference to FIG. 3 may be repeated with each successive stroke on a single fairway segment, while the additional steps outlined with reference to FIG. 4 may be used where the objective changes after each stroke.

Figure 5:
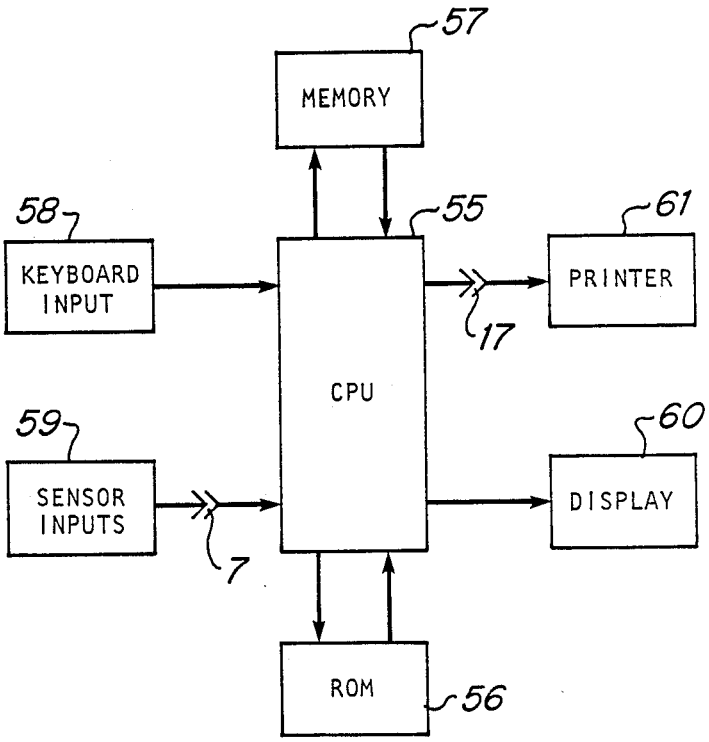
FIG. 5 is a block schematic diagram of one embodiment of the present invention.

Referring now to FIG. 5, there is shown a block schematic diagram of one embodiment of the present invention. A central processing unit (CPU) 55 of conventional design is coupled to a read-only memory (ROM) 56 which provides the program instructions and algorithms by which the central processing unit 55 performs the calculations and other described operations to display performance characteristics and distances according to the present invention. Memory 57 is coupled to the central processing unit 55 to store the temporary distances attained and remaining on each stroke, as well as the performance characteristics with selected clubs on previous strokes. Preferably, at least the portion of the memory that stores the performance characteristics of previous strokes is non-volatile to retain the stored data after the unit is shut off.

Information and operation instructions for the CPU 55 are entered through the keyboard 54 and its special function keys. Distance data via sensor 9, cable 8, and connector 7 and angle data via pointers 15 and 25 associated angle transducer (not shown) are provided directly through the sensor inputs 59. As discussed above, these may include conventional pulse counter and angle transducer.

Display 60 is a conventional liquid crystal or light-emitting diode device, and a printer 61 may be incorporated into the unit 12, or may be coupled to the unit 12 via an interface connection 17.

Referring now to the table of FIG. 6, there is shown a graphic illustration of one format for storage of information in memory 57 about the distance performances previously achieved using various designated clubs. Each of the information 'bins' 63 will store therein the distance a ball was hit with the designated club associated therewith. As the available 'bins' for a given club fill up in succession with distance information from previous strokes with such club (say, 10 'bins', or other convenient number of 'bins'), the oldest information is discarded as newest information is included. With the distance information per club thus stored, the central processing unit 55 may compare a distance-remaining calculation with the closely-related distances in storage for designated clubs, and can select for display the number of the particular club with which such distance was previously attained.

Alternatively, the central processing unit 55 may perform standard averaging, or geometric mean analysis, or the like, on the distance data stored per club (on subsets of such data stored per club) before comparing a distance-remaining calculation with such modified data to display a suggested club.

Figure 7A:
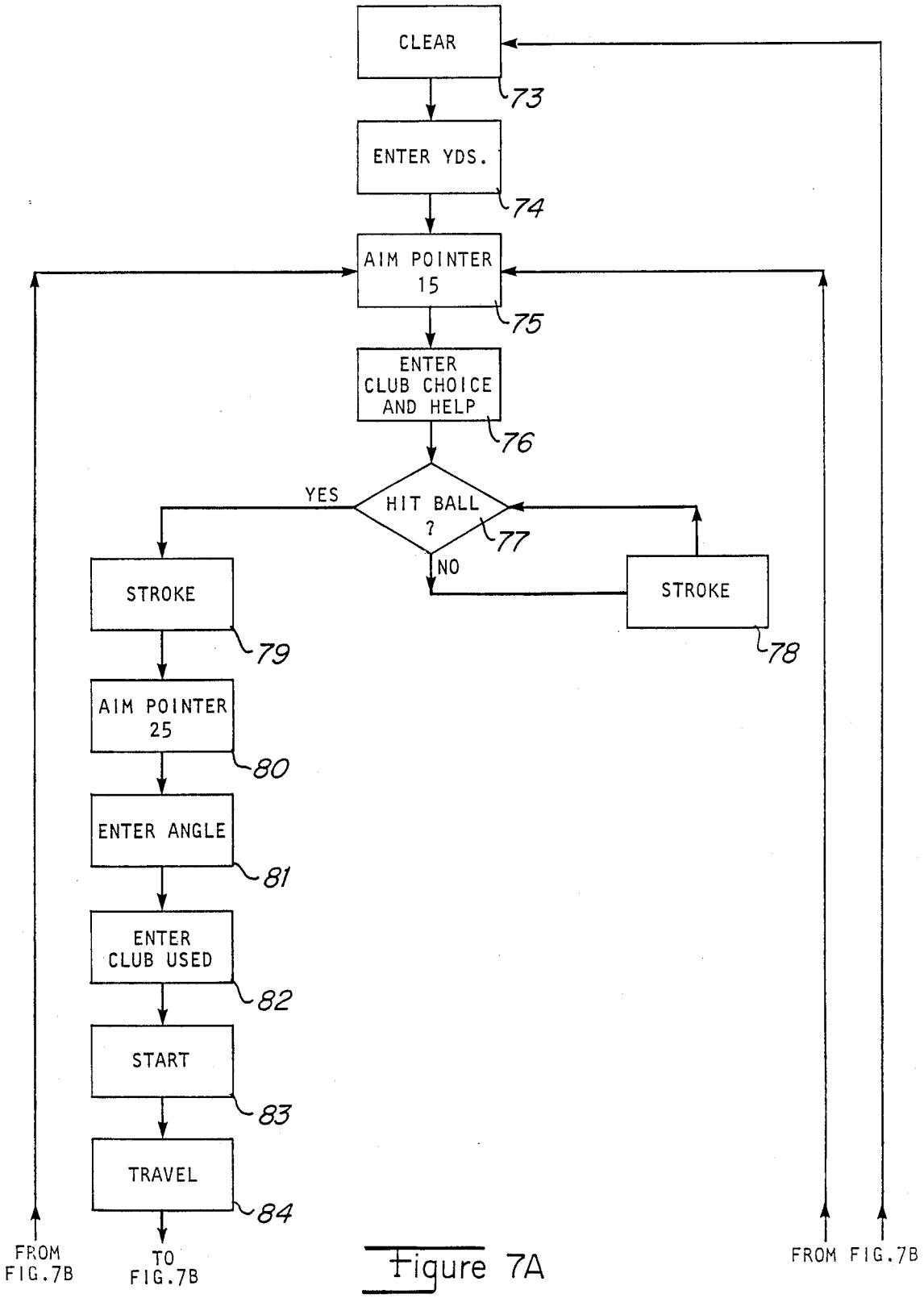
Figure 7B:
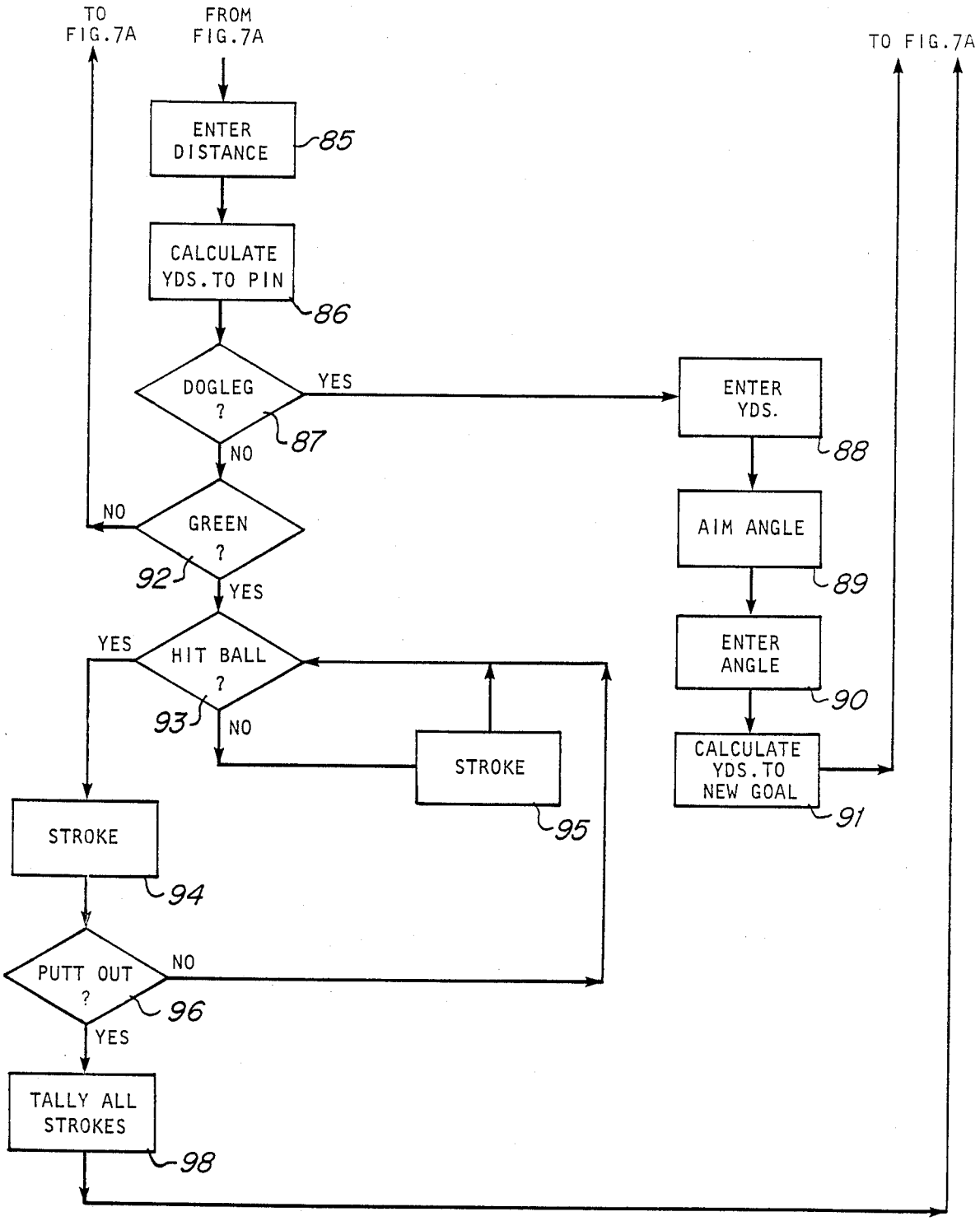

Referring now to FIG. 7A and 7B, there is shown a flow chart which illustrates the steps involved in operation of the present invention. Initially, various memory or storage registers may be cleared 73 of their previous values. Of course, the registers in memory 57 that store the distance data per club (FIG. 6) are normally not reset for each new pin. The official yardage to the pin is then entered 74 and the angle-measuring device is referenced or 'zeroed' 75 by aiming one pointer 15 along the line of sign from the tee-off point to the pin. The player may receive display 75 of distances previously attained with given clubs. All strokes must be entered 77, 78, 79 via the special function 'stroke' keys.

Once the ball has been hit, the angle relative to the line of sight of the line to the location of the ball is then determined by aiming the other pointer 25 at the location of the ball, and such angle is then entered 80, 81 in step 81. In addition, the club that was actually used must be entered 82.

The memory registers and bins 57, display 60 and CPU 55 are prepared to receive data from the wheel sensor unit 9 by pressing the special function 'START' key 28. The user travels 84 to the location where the ball came to rest and enters 85 the distance and then calculates 86 the remaining distance to pin via the special function 'CALCULATE' key 30.

If it is determined 87 that the player will be hitting through a 'dog-leg' (i.e., new objective), then new yardage must be entered 88, pointer 15 and 25 must be aimed 89, and the new angle must be measured and entered 90. Then the remaining distance to the new objective may be calculated 91. If it is determined that the objective has not changed 87, then it must be determined 92 if the player is on the green. If so, then remaining distance is not a concern, and the ball is hit and all strokes must be entered 94, 95 via the special function 'STROKE' key 24. If the last stroke did not finish play for the hole, the player hits (or putts) until finished and then tallies all strokes 98 for display and clears the temporary registers 57 (but not separate stroke and putt counters and not the bins of distance information for each club) and begins play on the next hole. If it is determined 92 that the user is not on the green, then the angle-measuring device is 'zeroed' and the angle is entered 75 in order to prepare for the next stroke.

I claim:

1. A method of operating on golf-game parameters based upon a player's present and previous activities on a course, the method comprising the steps of:

storing information about a distance from one location to a selected objective on the course;

storing information about a golf club used presently in advancing the golf ball from the one location to the selected objective:

determining a distance by which the golf ball is presently advanced toward the selected objective;

storing the determined distance in association with the golf club presently used;

determining presently-remaining distance by which the golf ball is to be advanced to the selected objective;

accessing from storage each distance previously achieved with a selected club;

comparing each distance previously attained with a selected club with the presently-remaining distance; and displaying at least one suggested club to be used in advancing the golf ball over the presently-remaining distance to the selected objective.

2. The method according to claim 1 wherein in the step of determining presently-remaining distance, increments of distance are accumulated as the player advances substantially in direct line to a location of the golf ball intermediate the one location and the selected objective;

an angle between a line from the one location to the selected objective and said direct line is detected; and the presently-remaining distance to the selected objective is determined with respect to the stored distance from the one location to the selected objective, said detected angle, and the increments of distance accumulated to the location of the golf ball.

3. The method according to claim 1 wherein in the step of accessing, each stored distance associated with each selected club is averaged for such selected club; and in the step of comparing;

the averages of distances attained with selected clubs are compared with the presently-remaining distance.

4. Apparatus for providing golf-game parameters based upon a player's previous and present activities on a golf course, the apparatus comprising:

storage means having a plurality of accessible storage locations therein for storing information about golf clubs and distances;

entry means coupled to the storage means for manually entering information about distance to a selected objective and about clubs used to advance a golf ball to the selected objective;

sensor means disposed to detect a distance substantially in a direct line to a location on the course to which the golf ball was advanced;

processor means coupled to the storage means and to the sensor means and to the entry means for determining a remaining distance to the selected objective from the location to which the golf ball was advanced, said processor means being operated to access from the storage means the distances stored therein attained with selected clubs for comparison with the determination of remaining distance to the selected objective; and display means coupled to the processor means for displaying information about at least one club for use in advancing the golf ball over the remaining distance to the selected objective.

5. Apparatus as in claim 4 comprising:

angle detecting means coupled to the processor means and operated to produce information about an angle between said direct line and a line from the location of the golf ball to the selected objective;

said processor means operates on the angle information and on information about the distance to the selected objective and on the distance along said line for displaying on the display means information about at least one club for advancing the golf ball over the remaining distance to the selected objective.

6. Apparatus as is claim 4 wherein said storage means stores therein information about the distances previously achieved with each selected club; and said processor means operates to access the storage locations in said storage means for averaging a selected plural member of distances previously attained with each selected club for comparing the distance remaining to the selected objective with said averages of distances attained with each selected club for displaying on said display means information including a selected club to use in advancing the golf ball over the remaining distance to the selected objective.

* * * * *